US006254080B1

(12) United States Patent
Bass

(10) Patent No.: US 6,254,080 B1
(45) Date of Patent: Jul. 3, 2001

(54) PAPER SHEET CONTROLLING APPARATUS AND METHOD OF USING SAME

(75) Inventor: Douglas Bass, Westminster, CA (US)

(73) Assignee: BDT Products, Inc., Irvine, CA (US)

( * ) Notice: Subject to any disclaimer, the term of this patent is extended or adjusted under 35 U.S.C. 154(b) by 0 days.

(21) Appl. No.: 09/438,187

(22) Filed: Nov. 11, 1999

(51) Int. Cl.[7] ..... B65H 5/00; B65H 3/06
(52) U.S. Cl. ..... 271/10.11; 271/117
(58) Field of Search ..... 271/117, 10.11, 271/10.06, 10.07, 10.08, 34, 35; 400/629; 414/797.2, 797.6

(56) References Cited

U.S. PATENT DOCUMENTS 3,749,395 * 7/1973 Bazzarone et al. ..... 271/4 X
3,768,803 * 10/1973 Strange ..... 271/34 X
5,074,540 * 12/1991 Belec et al. ..... 271/34
6,164,432 * 12/2000 Monsees ..... 198/449.4 X

* cited by examiner

*Primary Examiner*—Christopher P. Ellis
*Assistant Examiner*—Kenneth W Bower
(74) *Attorney, Agent, or Firm*—Foley & Lardner; Bernard L. Kleinke

(57) ABSTRACT

A method and apparatus for controlling the movement of paper sheets from a paper tray or the like is disclosed, and includes using a moveable sheet feeding device for removing the topmost single sheet from a stack of paper sheets seriatim to feed them along a path of travel to a paper printing station. A retractable guide device is used for helping to guide the sheets and to help retain them in the desired path of travel, and thus prevents the paper sheets from curling or other moving away from the path of travel. An end portion of the guide device is connected to and moves with a paper feeding mechanism as it continues to move downwardly into engagement with the current topmost sheet of the stack as it diminishes during a paper feeding operation.

15 Claims, 3 Drawing Sheets

PAPER SHEET CONTROLLING APPARATUS AND METHOD OF USING SAME

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO A "MICROFICHE APPENDIX"

Not Applicable

BACKGROUND OF THE INVENTION

1. Technical Field

The present invention relates in general to a sheet paper controlling apparatus and method of using it, and it more particularly relates to a paper sheet controlling mechanism for helping to guide individual sheets of paper being fed seriatim to a printing station, such as a laser printing engine.

2. Background Art

There have been many different types and kinds of paper feeding and controlling mechanisms used for non-impact printers, such as laser printers or the like. For example, conventionally a stack of paper sheets contained in a paper tray of a laser printer is fed one sheet at a time to the laser printing engine for printing individual paper sheets. There have been a variety of different types and kinds of mechanisms for transporting the top sheet of the stack to the printing station. Such mechanisms must, for some applications, deliver the paper sheets at a high rate of speed within an acceptable jam rate.

One highly successful feeding mechanism is disclosed in U.S. Pat. No. 5,377,969, which is incorporated herein by reference as if fully set forth herein. The patented feed mechanism includes a pivotally mounted feed arm which extends into the open top paper tray and engages the top sheet of the stack. When the mechanism is activated, the top sheet is ejected from an angled end wall of the tray, and is delivered therefrom to the printing station.

While such a mechanism has proven to be highly successful for many applications, under some circumstances and some applications, the paper sheet being fed from the top of the stack along the angled wall of the tray can curl back away from the angled wall and out of its desired path of travel to a slight extent, thereby causing an undesirable and unwanted paper feeding jam. The curling of the paper sheet can be caused by a variety of conditions, including humid ambient conditions causing the natural paper curl to be exaggerated. Another reason for causing a paper jam is that the paper sheet can have a bent or curled corner, thereby causing interference with the desired smooth uninterrupted movement of paper sheets along the paper path.

Therefore, it would be highly desirable to have a new and improved paper controlling technique for helping guide the top sheet of a stack of paper sheets from a paper tray in an uninterrupted manner within tolerable jam rates. In this regard, such a mechanism should help reduce any unwanted and undesirable paper jams in an effective and relatively inexpensive manner. Also, such a mechanism should be continuously effective as the heigth of the stack diminishes during the process of feeding paper sheets individually therefrom down to the last sheet in the paper tray.

SUMMARY OF THE INVENTION

Therefore, the principal object of the present invention is to provide a new and improved paper sheet controlling apparatus and method of using it, wherein paper sheets being fed from a stack of like paper sheets is facilitated to reduce the possibility of unwanted paper jams.

Another object of the present invention is to provide such a new and improved method and apparatus for controlling the movement of paper sheets, wherein the method and apparatus continues to function effectively at substantially all phases of the feeding operation as the heigth of the stack diminishes during the process of feeding paper sheets individually therefrom down to the last sheet of the stack.

A further object of the present invention is to provide such a new and improved method and apparatus for controlling paper sheet movement for utilization in a paper tray employed in a printing system, such as a laser printing system.

Briefly, the above and further objects of the present invention are realized by providing a paper controlling method and apparatus for operation within a paper tray for helping control the movement of each sheet of paper being fed from a paper stack contained within the tray in a smooth, uninterrupted manner, to reduce the jam rate.

A method and apparatus for controlling the movement of paper sheets from a paper tray or the like is disclosed, and includes using a moveable sheet feeding device for removing the topmost single sheet from a stack of paper sheets seriatim to feed them along a path of travel to a paper printing station. A retractable guide device is used for helping to guide the sheets and to help retain them in the desired path of travel, and thus prevents the paper sheets from curling or other moving away from the path of travel. An end portion of the guide device is connected to and moves with a paper feeding mechanism as it continues to move downwardly into engagement with the current topmost sheet of the stack as it diminishes during a paper feeding operation.

BRIEF DESCRIPTION OF DRAWINGS

The above mentioned and other objects and features of this invention and the manner of attaining them will become apparent, and the invention itself will be best understood by reference to the following description of the embodiment of the invention in conjunction with the accompanying drawings, wherein.

BEST MODE FOR CARRYING OUT THE INVENTION

Figure 1:
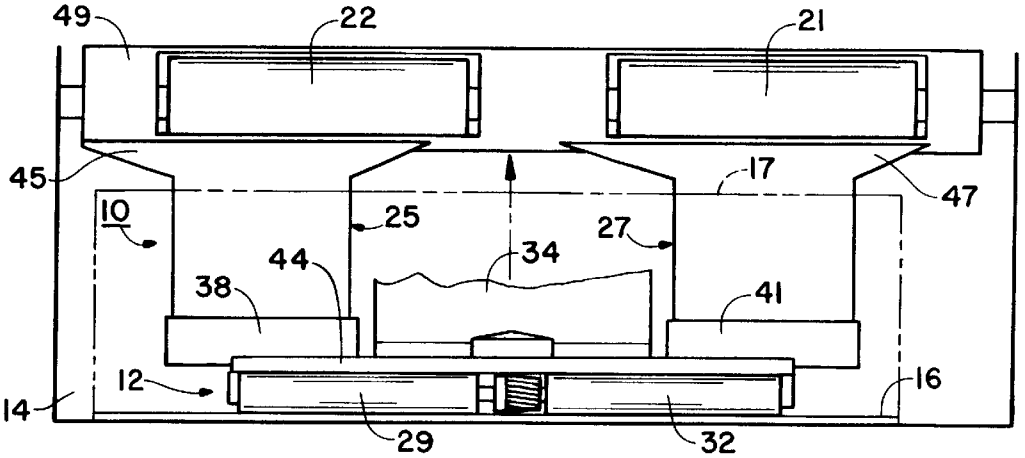
FIG. 1 is a diagrammatic, fragmentally end elevational view of a paper sheet controlling apparatus, which is constructed in accordance with the present invention and which is shown mounted within a paper storage tray in operative association with a paper feed mechanism for a laser printer.

Referring now to FIGS. 1, 2, 3, 4 and 5 of the drawings, there is shown a paper sheet controlling apparatus 10, which is constructed in accordance with the present invention, and which is mounted to a paper feed arm mechanism 12 pivotally mounted within an open top rectangular paper tray 14 for a laser printer housing 15 form a part of a laser printer (not shown) for feeding individually paper sheets from a stack 16 of paper sheets to a printing station (not shown). The operation of the feed arm mechanism 12 is more fully described in U.S. Pat. No. 5,377,969. However, it may become apparent to those skilled in the art that the paper sheet controlling apparatus of the present invention may also be used in connection with a variety of different types and kinds of paper feeding mechanisms. Also, it should be understood by those skilled in the art that the paper sheet controlling apparatus of the present invention may be used in operative association with many different types and kinds of printing systems, including impact as well as non-impact printing systems.

In operation, each individual paper sheet, such as the paper sheet 17 (FIG. 1) is fed from the top of the stack 16 along an angled end wall or dam 18 of the paper tray 14 forming a part of a paper path 20. As shown in FIG. 1, a pair guide rollers 21 and 22 mounted on the laser printer housing 15 above the dam 18 cooperate with oppositely disposed guide rollers, such as a guide roller 23 mounted on the paper tray 14 to deliver the paper sheets from an exit port 26 at the top of the tray 14.

The paper sheet controlling apparatus 10 includes a pair of spaced-apart retractable guide sheets 25 and 27 which are mounted on and carried by a pair of feed rollers 29 and 32 of the feed mechanism 12, which includes a spring biased feed roller support arm 34 which is pivotally mounted at its upper end at a pivot point 36 (FIGS. 3 and 4) to enable the feed rollers to engage continuously the top sheet of the stack 16 as it diminishes within the tray 14. A pair of guide sheet housings 38 and 41 are mounted on a feed roller support 44 and confine therein a pair of springy sheet coiled ends, such as a coiled end 43 of the guide sheet 25 for enabling the guide sheet 25 to move extensively with the feed rollers as they descend into the interior of the tray 14 as the sheet diminishes in heigth when the sheets are fed from the stack 16. The guide sheets 25 and 27 include a pair of upper enlarged portions 45 and 47 fixed to a deflector plate 49.

Figure 5:
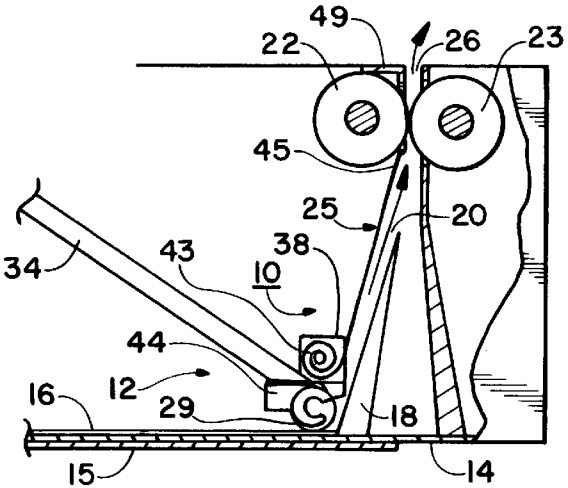
FIG. 5 is a diagrammatic, fragmentary sectional side elevational view similar to the view of FIG. 4, but illustrating only a single sheet of paper remaining in the tray.
Figure 4:
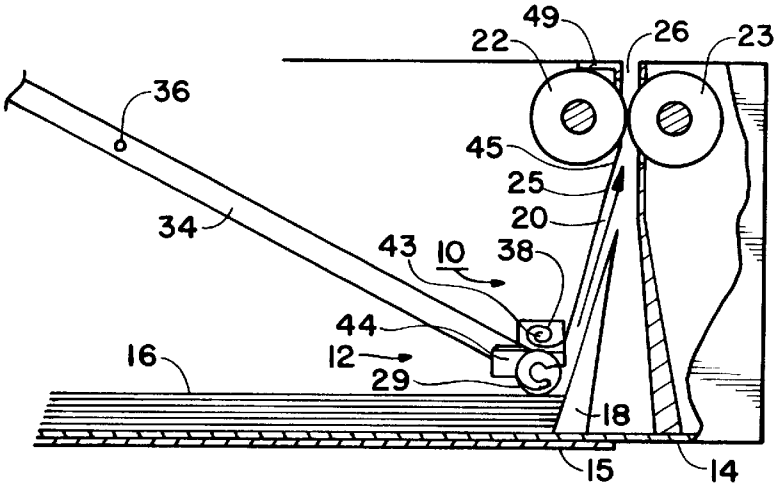
FIG. 4 is a diagrammatic, fragmentary sectional side elevational view of the paper sheet controlling apparatus similar to FIG. 3, but illustrating only a small quantity of the paper sheets remaining in the tray.
Figure 3:
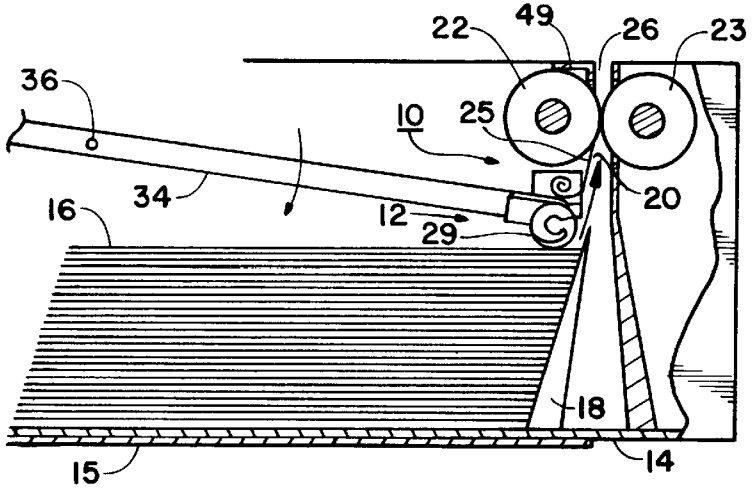
FIG. 3 is a diagrammatic, fragmentary sectional side elevational view of the paper sheet controlling apparatus of FIG. 1, illustrating the paper tray in its closed position within the laser printer housing and having a full stack of paper sheets ready for delivery from the paper tray.

In accordance with the present invention, the guide sheets 25 and 27 extend in a spaced apart manner as shown in FIG. 1 between the feed rollers 29 and 32 and the upper guide rollers 22 and 21 respectively. As shown in FIGS. 3–5, the sheets extend in a generally parallel disposition relative to the angled face of the dam 18 as the feed arm mechanism 12 descends into the interior of the tray 14. Thus, the retractable guide sheets are pulled downwardly by the mechanism 12, and in so doing, the coiled end uncoils so that the sheets move extensively. The guide sheets 25 and 27 help to guide the paper sheets as they travel along the path of travel 20. In this regard, the guide sheets help to retain the paper sheets in the desired path of travel, and thus they prevent the paper sheets from curling or otherwise moving away from the path of travel 20 along the face of the dam 18 to the guide rollers and out the exit post 26.

Figure 2:
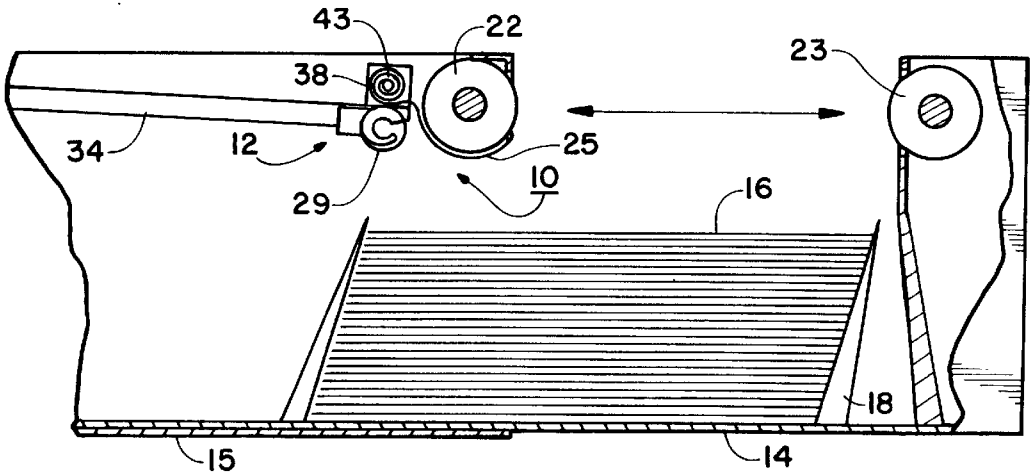
FIG. 2 is a diagrammatic, fragmentary sectional side elevational view of the apparatus of FIG. 1, illustrating the tray in a partially disassembled condition relative to its laser printer housing.

In use, once the stack 16 of paper sheets are mounted within the paper tray 14 in a beveled manner as indicated in FIG. 2, and then the paper tray 14 is slid into position within the laser printer housing 15. The spring biased feed arm 34 is maintained in a generally horizontal position to position the guide sheets above the stock 16. Thereafter, the motor driven rollers 29 and 32 are lowered into engagement wit the topmost sheet. The rollers are energized to deliver the top sheet, such as the sheet 17 along the paper path 20 to exit the port 26. The retractable guide sheets, such as the sheet 25, as best seen in FIG. 3, extend between the deflector plate 49 and the feed roller support 44 to help prevent the sheet, such as the paper sheet 17 moving along the path of travel 20 toward the rollers 22 and 23 to curl or bend backwardly away from the angled wall 18 to produce a jam. In accordance with the present invention, the retractable guide sheets 25 and 27 move with the feed rollers as they continue to engage the topmost sheet of the stack 16 until the last sheet of the stack 16 is engaged as shown in FIG. 5, since the sheets 25 and 27 uncoil as the feed arm 37 moves pivotally downwardly and the feed rollers 29 and 32 descend into the tray 14 to maintain the feed rollers in engagement with the topmost sheet of the stack.

The springy nature of the coiled ends of the sheets 25 and 27, such as the coiled end 43, provide a spring tension on the sheet 25 to maintain it taut as the feed roller 29 descends. The spring tension on the sheets 25 and 27 are somewhat weak and cooperate with the feed arm retraction spring (not shown) to provide a balance therebetween. In this regard, the amount of spring tension applied by the coiled ends of the sheets is sufficiently weak to prevent an unwanted upward force on the feed arm 34.

The retractable guide sheets 25 and 27 are composed of a suitable film material to be sufficiently pliable and resilient so that it can be coiled and uncoiled in a smooth and continuous manner.

Figure 6:
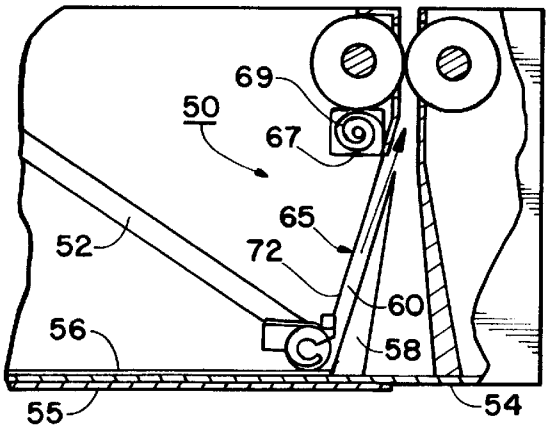
FIG. 6 is a diagrammatic, fragmentary sectional side elevational view of another paper sheet controlling apparatus, which is constructed in accordance with the present invention.

Referring now to FIG. 6, there is shown another paper sheet controlling apparatus generally indicated at 50, which is also constructed in accordance with the present invention, and which is similar to the paper sheet controlling apparatus 10 of FIG. 1, except that the apparatus 50 has its coiled end mounted in a fixed manner. The paper sheet controlling apparatus 50 cooperates with a paper feed arm mechanism 52 which extends pivotally downwardly into a paper tray 54 mounted within a laser printer housing 55 to engage the topmost paper sheet of a paper sheet stack 56. The paper sheets are guided upwardly along an angled end wall or dam 58 of the tray 54 along a paper path generally indicated at 60 in a similar manner as the paper feeding operation described in connection with the description of the apparatus 10 of FIGS. 1–5.

The apparatus 50 includes a pair of retractable guide sheets, such as a guide sheet 65 extending between an upper fixed guide sheet housing 67 which confines a springy sheet coil end 69 of the sheet 65, and a lower fixed end 72 of the sheet 65 fixed to and moveable with the paper feed arm mechanism 52. In this manner, as the paper feed arm mechanism 52 descends pivotally into the interior of the tray 54, the sheet 65 moves extensively therewith as the coiled end 69 uncoils to help retain the paper sheets being ejected from the tray 54 along the desired paper path 60 without curling or bending back away from the angled wall 58 in a similar manner as the guide sheets 25 and 27 of the apparatus 10 of FIG. 1.

Figure 8:
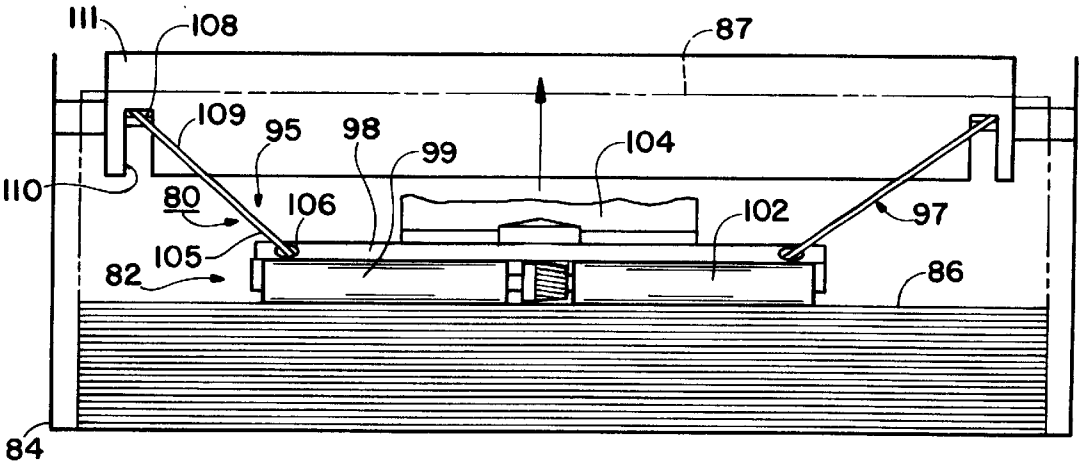
FIG. 8 is a diagrammatic, fragmentary end elevational view of the apparatus of FIG. 7.
Figure 7:
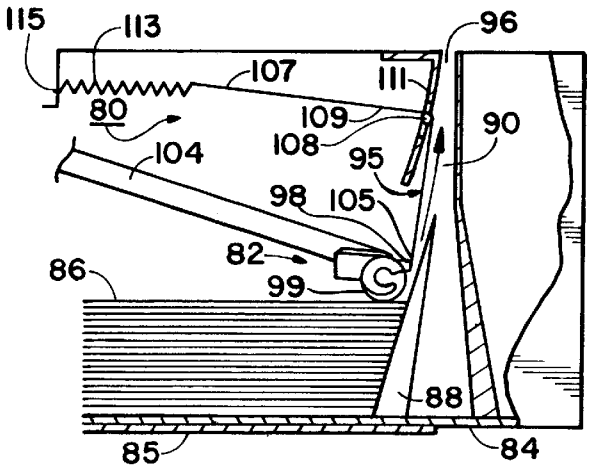
FIG. 7 is a diagrammatic, fragmentary sectional side elevational view of a further paper sheet controlling apparatus, which is constructed in accordance with the present invention.
Figure 9:
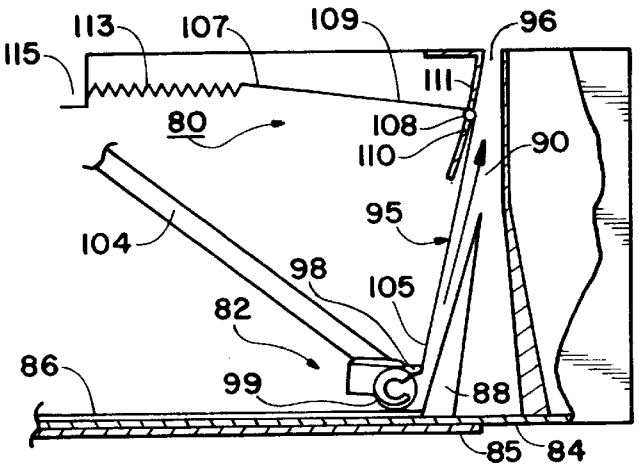
FIG. 9 is a diagrammatic, fragmentary sectional side elevational view of the apparatus of FIG. 7, illustrating only a single paper sheet remaining in the tray.

Referring now to FIGS. 7, 8, and 9, there is shown a paper sheet controlling apparatus generally indicated at 80, which is constructed in accordance with the present invention, and which operates in a similar manner as the apparatus 10 of FIGS. 1–5. The apparatus 80 is attached to a paper feed arm mechanism generally indicated at 82 pivotally mounted to depend into a paper tray 84 mounted within a laser printer housing 85 to engage a paper sheet stack 86 resting in the paper tray 84 for feeding individual paper sheets, such as a paper sheet 87 (FIG. 8) along an angled back wall or dam 88 of the tray 84 to guide the paper sheet 87 along a paper path generally indicated at 90 to exit the tray 84 at a top exit port 96.

The apparatus 80 generally includes a pair of retractable guide lines 95 and 97 which extend between the ends of an elongated horizontal feed roller support 98 for a pair of feed rollers 99 and 102 of the mechanism 82 at lower fixed ends of the lines 95 and 97, such as a lower fixed end 105 of the line 95, and upper fixed ends of the lines 95 and 97, such as an upper moveable end 107 of the guide line 95. In this manner, as the paper feeder mechanism 82 descends into the tray 84 from a position as indicated in FIG. 7, to a position as indicated in FIG. 9 where the last sheet of paper is ready to be fed from the tray 84. The lines 95 and 97 are pulled by the mechanism 82 extensively downwardly angularly into the hollow interior of the tray 84 as the mechanism 82 descends. In this manner, the pair of lines, such as the line 95, serves a similar function as the pair of guide sheets of FIGS. 1–5. In this regard, the paper sheets being fed are prevented from curling or bending backwardly away from the angled face of the dam 88 and are retained in the desired paper path 90.

The retractable lines 95 and 97 extend upwardly angularly from the ends of the feed roller support 98 to the opposite end portions of the deflector plate 111 to provide a desirable V-shape configuration as best seen in FIG. 8. In such a configuration, the paper sheets such as the paper sheet 87 is confined to the paper path 90 with curling away from the dam 88. Also, with the V-shaped configuration, if a corner portion of the paper sheet 87 is bent, it becomes straightened by the lines 95 and 97 to avoid a paper jam.

Considering now the guide lines 95 and 97 in greater detail, only the guide line 95 will now be considered since the lines 95 and 97 are similar to one another. The guide line 95 is generally composed of a suitable material such as a steel wire or a nylon coated wire. As shown in FIG. 8, an opening 106 in one end of the feed roller support 98 receives the lower fixed end 105 of the line 95 and is secured in place by any suitable technique such as knotting the bottom end 105 of the line 95 at the back of the feed roller support 98. There are other suitable techniques for fixing the bottom end 105 of the line 95 to the feed roller support 98 as will become apparent to those skilled in the art. An intermediate portion 109 of the line 95 extends angularly from the bottom end 105 over a roller 108 mounted in an opening 1 10 in the deflector plate 111 serving a portion of the paper path 90 therein, and extends therefrom to a tension coil spring 113, fixed at its back end to a housing portion 115 of the laser printer housing 85. In this manner, as the feed roller support 98 and its feed rollers 99 and 102 move downwardly within the interior of the tray 84, the tension spring 113 extends as the line 95 is pulled downwardly so that the paper being fed is controlled at every position of the paper feed arm mechanism 82 in accordance with the present invention.

Figure 11:
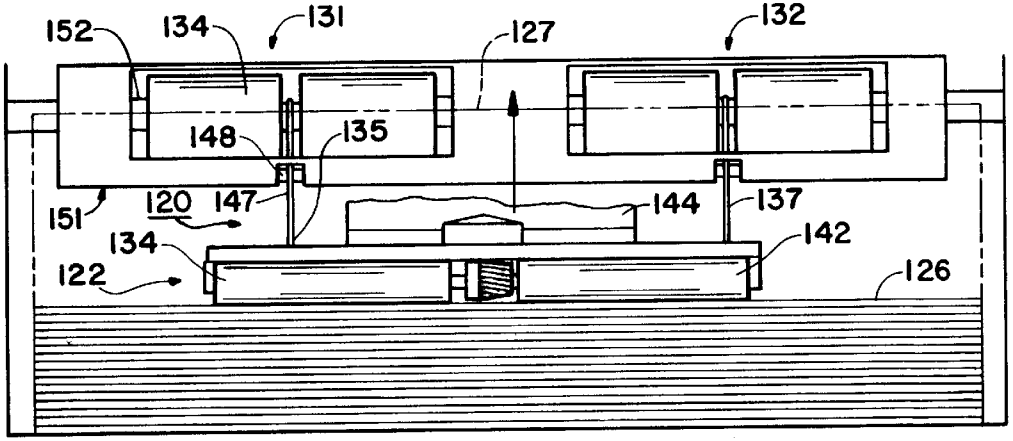
FIG. 11 is a diagrammatic, fragmentary end elevational view of the apparatus of FIG. 10.
Figure 10:
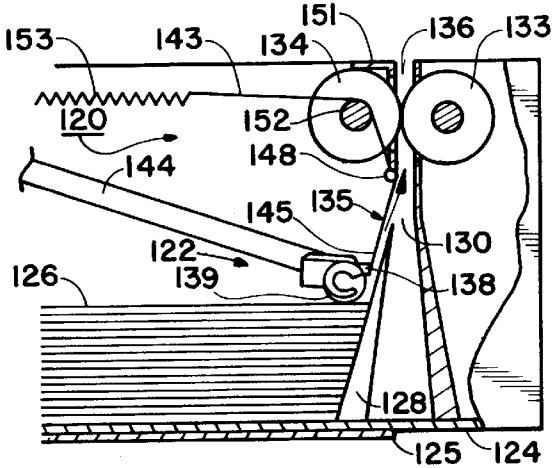
FIG. 10 is a diagrammatic, fragmentary sectional side elevational view of yet a further paper sheet controlling apparatus, which is constructed in accordance with the present invention.
Figure 12:
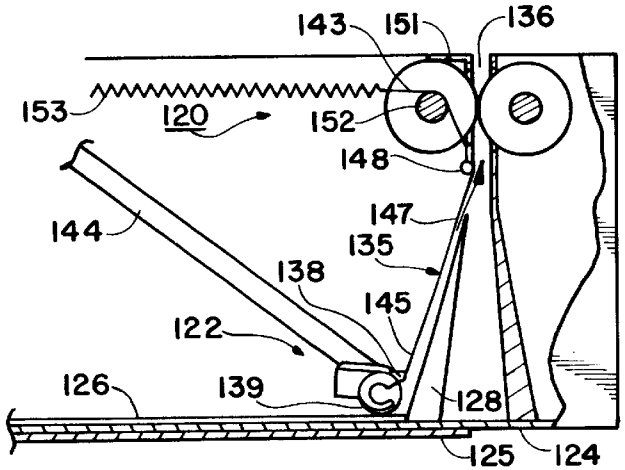
FIG. 12 is a diagrammatic, fragmentary sectional side elevational view of the apparatus of FIG. 10, illustrating only a single sheet remaining in the paper tray.

Referring now to FIGS. 10, 11 and 12, there is shown yet another paper sheet controlling apparatus generally indicated at 120, which is also constructed in accordance with the present invention, and which is similar to the apparatus 80 of FIGS. 7–9. The apparatus 120 is attached to a paper feed arm mechanism 122 for a paper tray 124 of a laser printer housing 125 for feeding individual paper sheets from a paper sheet stack 126 in the tray 124. As best seen in FIG. 10, a paper sheet, such as a paper sheet 127 is fed along an angled back wall or dam 128 of the tray 124 along a paper path 130. A pair of guide rollers 131 and 132 are mounted on the housing 125 and cooperate with guide rollers, such as a guide roller 133 mounted on the tray 124 to cooperate with the opposed housing guide roller 134 of the pair 131, to help eject the paper sheets, such as the sheet 127 via an exit port 136.

The apparatus 120 includes a pair of parallel extending retractable guide lines 135 and 137, which are generally similar to the guide lines 95 and 97 of FIG. 8, for helping to prevent the paper sheet being fed from curling or folding away from the angled face of the dam 128 of the tray 124. The retractable lines 135 and 137 are disposed generally parallel to one another and extend between an elongated feed roller support 138 for a pair of motor driven feed rollers 139 and 142 on the free distal end of a pivotally mounted feed arm 144, and movable end portions of the lines 135 and 137, such as a moveable end portion 143 of the line 135.

Considering now the line 135 in greater detail, it should be understood that the lines 135 and 137 are similar to one another, and therefore only the line 135 will now be described in greater detail. The line 135 is preferably composed of a steel wire or a Nylon coated wire, and is fixedly connected at its lower end 145 to the feed roller support 138 by suitable attaching means (not shown). An intermediate portion 147 of the line 135 extends over a roller 148 mounted at a lower portion of a deflector plate 151 for forming a portion of the paper path 130 and for supporting the pairs of guide rollers 131 and 132 on a guide roller axial 152. The intermediate portion 147 of the line 137 extends from the roller 148 and over the guide roller axial 152 and terminates at the moveable end portion 143 of the line 135. A coil spring 153 is stretched between the moveable end portion 143 and a fixed portion (not shown) of the housing at 125 to serve a similar purpose as the spring 113 of FIG. 7.

While particular embodiments of the present invention have been disclosed, it is to be understood that various different modifications are possible and are contemplated within the true spirit and scope of the appended claims. There is no intention, therefore, of limitations to the exact abstract or disclosure herein presented.

What is claimed is:

1. An apparatus for controlling he movement of individual sheets along a path of travel from a stack of sheets, comprising:

a movable sheet feeding means for continuously engaging and removing topmost single sheets from the stack seriatim to feed them along the path of travel;

retractable guide means connected to said sheet feeding means and extending along and forming a portion of the paper path for helping to guide the moving sheets along the path of travel; and spring means for enabling said guide means to move extensively with said sheet feeding means and for maintaining said guide means taut.

2. An apparatus according to claim 1, further including an angular dam for helping to confine the stack, wherein said guide means extends generally parallel to the face of said dam to help define the path of travel.

3. An apparatus according to claim 1, wherein said retractable guide means includes at least one guide sheet.

4. An apparatus according to claim 3, wherein said spring means includes at least one coiled end portion.

5. An apparatus according to claim 4, wherein said spring means includes means for mounting said coiled end portion on movable sheet feeding means.

6. An apparatus according to claim 4, wherein said spring means includes means for mounting said coiled end portion in a fixed manner above said sheet feeding means.

7. An apparatus according to claim 1, wherein said retractable guide means includes at least one line.

8. An apparatus according to claim 7, wherein said line is composed of steel wire.

9. An apparatus according to claim 7, wherein said line is composed of Nylon coated wire.

10. An apparatus according to claim 7, wherein said spring, means includes a spring extending between an end of said line and a fixed member.

11. An apparatus according to claim 7, further including another line.

12. An apparatus according to claim 11, wherein the first-mentioned and said another lines are generally disposed in a V-shape.

13. An apparatus according to claim 11, wherein the first mentioned and said another lines are generally disposed in a parallel configuration relative to one another.

14. In a laser printer housing, an apparatus for controlling the movement of individual sheets along a path of ravel from a stack of sheets, comprising:

an open top paper tray mounted within the housing for storing the stack;

movable sheet feeding means extending into the path tray for engaging continuously and for removing topmost single sheets from the stack seriatim to feed them along the path of travel;

retractable guide means connected to said sheet feeding means and extending along and forming a portion of the paper path for helping to guide the moving sheets along the path of travel; and spring means for enabling said retractable guide means to move extensively with said feeding means and for maintaining said guide means taut.

15. A method for controlling the movement of individual sheets along a path of travel from a stack of sheets, comprising:

using a moveable sheet feeding means for continuously engaging and removing topmost single sheets from the stack seriatim to feed them along the path of travel;

using retractable guide means for helping to guide the sheets along the path of travel; and moving a free end portion of said retractable guide means with said feeding means as it continue to move into engagement with the topmost sheet as the stack diminishes.

* * * * *